US008550022B2

(12) United States Patent
Becher

(10) Patent No.: US 8,550,022 B2
(45) Date of Patent: Oct. 8, 2013

(54) TRANSPORTABLE AND BUILT ON-SITE CONTAINER APPARATUS WITH CONTROLLED FLOATATION AND WITH SELF-COLLECTING MEANS FOR WATER FLOODING EMERGENCY

(76) Inventor: Yona Becher, Budd Lake, NJ (US)

( * ) Notice: Subject to any disclaimer, the term of this patent is extended or adjusted under 35 U.S.C. 154(b) by 369 days.

(21) Appl. No.: 12/932,072

(22) Filed: Feb. 18, 2011

(65) Prior Publication Data

US 2012/0211502 A1 Aug. 23, 2012

(51) Int. Cl.
*B65D 88/52* (2006.01)
*B65D 88/54* (2006.01)

(52) U.S. Cl.
USPC ..... 114/256; 220/565; 220/611; 220/615

(58) Field of Classification Search
USPC ..... 114/256; 220/565, 567.1, 581, 586, 220/588–591, 611, 615; 137/197, 202
See application file for complete search history.

(56) References Cited

U.S. PATENT DOCUMENTS 3,270,905 A * 9/1966 Kroekel ..... 220/581
4,506,623 A * 3/1985 Roper et al. ..... 114/256
6,293,217 B1 * 9/2001 Savage et al. ..... 114/256
6,550,410 B2 * 4/2003 Reimers ..... 114/256
6,675,734 B2 * 1/2004 Eagles et al. ..... 114/256
6,739,274 B2 * 5/2004 Eagles et al. ..... 114/74 T
6,860,218 B2 * 3/2005 Eagles et al. ..... 114/256
7,197,997 B2 * 4/2007 Eagles et al. ..... 114/74 T
7,721,668 B2 * 5/2010 Eagles et al. ..... 114/256
2003/0081862 A1 * 5/2003 Eagles ..... 383/107

* cited by examiner

*Primary Examiner* — Craig Schneider

(57) ABSTRACT

Floating and towable multiple container apparatus, each container apparatus (18) attached to other container apparatus laterally and longitudinally. A Structural helical spring turns support continuous sealing wall (30) made of helix shaped plastic strip and consists of continuous multiple inflatable cavities (34) wrapped around and attached to spring turns.

A helical shape clamp (32) secures the sealing wall over the spring wire turns. A connection towing bar (44) connects the clamps over each wire spring turn together and provide cable connection means.

Two cap shape end covers (64) on both sides of the container with multiple external radial sealing members on its perimeter that engages the inner wall of the sealing wall (30) are pushed into the container apparatus, held with the helical spring wire turns that engage slots in the cap. Multiple water self-collecting one-way flow controls with float (86) allow water flow only into container with float held by inflated cavities in closed position.

6 Claims, 12 Drawing Sheets

TRANSPORTABLE AND BUILT ON-SITE CONTAINER APPARATUS WITH CONTROLLED FLOATATION AND WITH SELF-COLLECTING MEANS FOR WATER FLOODING EMERGENCY

BACKGROUND OF THE INVENTION

(A) Field of the Invention

The main field of the invention is relating to transportable and built on-site container apparatus with controlled floatation and with self-collecting means for emergency water flooding hazard.

As known, overflowing and flooded water keep causing enormous damage of tens of billions of millions of dollars every year around the world. In many cases overflowing water causes loss of human and animal lives.

When flooded water rise and spill over the banks of the river, it significantly damages houses, industrial plants, public facilities and lands and causes loss of lives of people and animals that were trapped and drowned by the uncontrolled gushing cold water flow.

During recent years, climate changes caused flooding and overflow of many large rivers in US, South America, Africa, Asia and around the world and causing major damage and loss of lives in cities and towns along the river time and again. The field of the invention is emergency transportable and built on-site container apparatus with controlled floatation and with self-collecting means of large volume of water.

In addition, the field of the invention includes configurations in which multiple container apparatus are attached together laterally and longitudinally for increased floatability and increased water carrying capability.

Another field of the invention is special means for self-collecting water from a river or reservoir into a large volume floatable container at remote locations where power is not available for operation of large capacity water pumps. Another field of the invention is self collecting and hauling of drinking or irrigation water from remote places to dry places and deserts around the world that need drinking water for their population and animals and for irrigation of their fields. Another field of the invention relates to low cost reusable container apparatus of drinking and irrigation water that is transported by towing from one remote location with excess water to places where rain is rare and where water supply is critical to sustain human lives in existing cities and to extending the population to new towns.

Additional field of the invention relates to collecting oil spills in sea in container to prevent oil spill to beaches.

Another field of the invention is relating to transparent floatable marine container apparatus for large fish and sea animals. In addition, the field of the invention is relating to towable container apparatus filled with drinking water or seawater and used for transport of large fish and sea animals from one remote place to another.

OBJECTS AND ADVANTAGES OF THE INVENTION

The main object of the invention is to provide transportable and built on-site container apparatus with controlled-floatability and with self-collecting means for emergency situation of water flood in remote locations.

More particular objects of the invention is to provide a container apparatus with large volume and with controlled floatation that is quickly built on site during hours in remote geographical locations of flooded river or water reservoir or oil spill container.

More particular objects of the invention is to provide built on site container apparatus with controlled floatability and with water self-collecting means that is easily transportable in emergency or normal situations and when time limitation is critical.

More particular object of the invention is to provide multiple container apparatus configurations with lateral and longitudinal arrangement of multiple container apparatus that are attached to each other.

The multiple container apparatus configurations can be transported before assembly either by boat, or by truck, or by helicopter or parachute air type transportation to remote areas with no connection roads.

Furthermore, the object of the invention is to provide low cost novelty means for an easily transportable built on-site container apparatus with controlled floatability and with self-collecting means for water over flooded river or large water reservoir in which the water is collected into the container from the river without the need of using special high power water pumping means.

Furthermore, the object of this invention is to provide lateral multiple-container apparatus configurations in which the main container is laterally supported by two or more containers that are structurally attached to the main container apparatus and provide additional controlled floatability means for increased fluid volume capacity within the main container and within the additional containers.

In addition, the object of this invention is to provide longitudinal multiple container apparatus configuration with towing means in which the multiple container apparatus configuration can be towed by boat along a river, water reservoir, or salted water sea.

Another objection of the invention is using the container apparatus as large transparent floatable aquarium means for large fish and sea animals of variable sizes or to transport fish and sea animals of variable sizes from one remote place to another.

Furthermore, the object of this invention is to provide low cost and reusable lateral multiple-container apparatus configurations for handling large amount of water made with parts that are easily assembled and then disassembled for repeatable application at low operation cost.

BRIEF DESCRIPTION OF THE DRAWINGS

The invention as herein described, by a way of example only, with reference to the accompanying drawings, wherein.

DESCRIPTION OF THE PREFERRED EMBODIMENT

Figure 1:
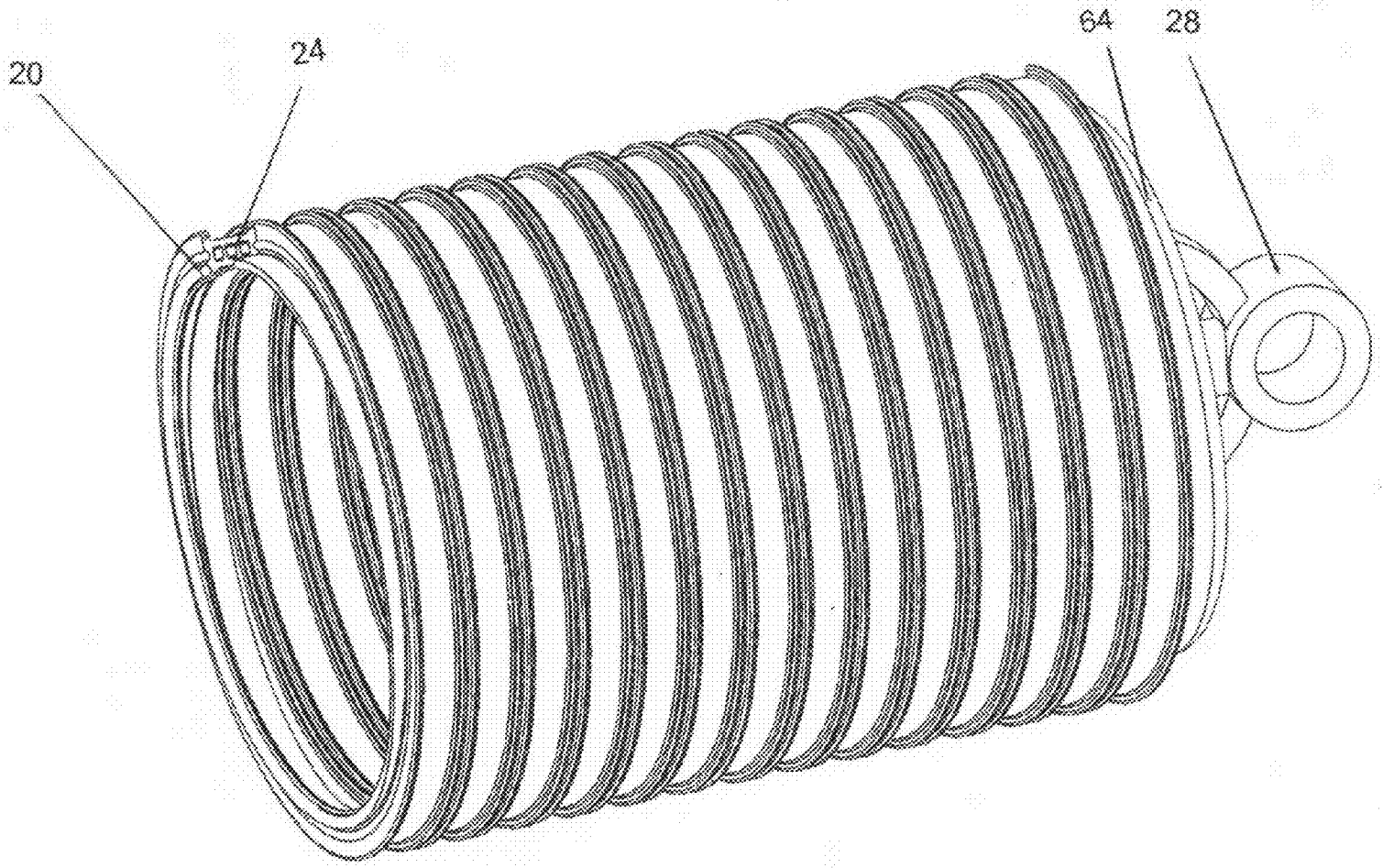
FIG. 1, is a three dimensional view of the a single container apparatus configuration
Figure 2:
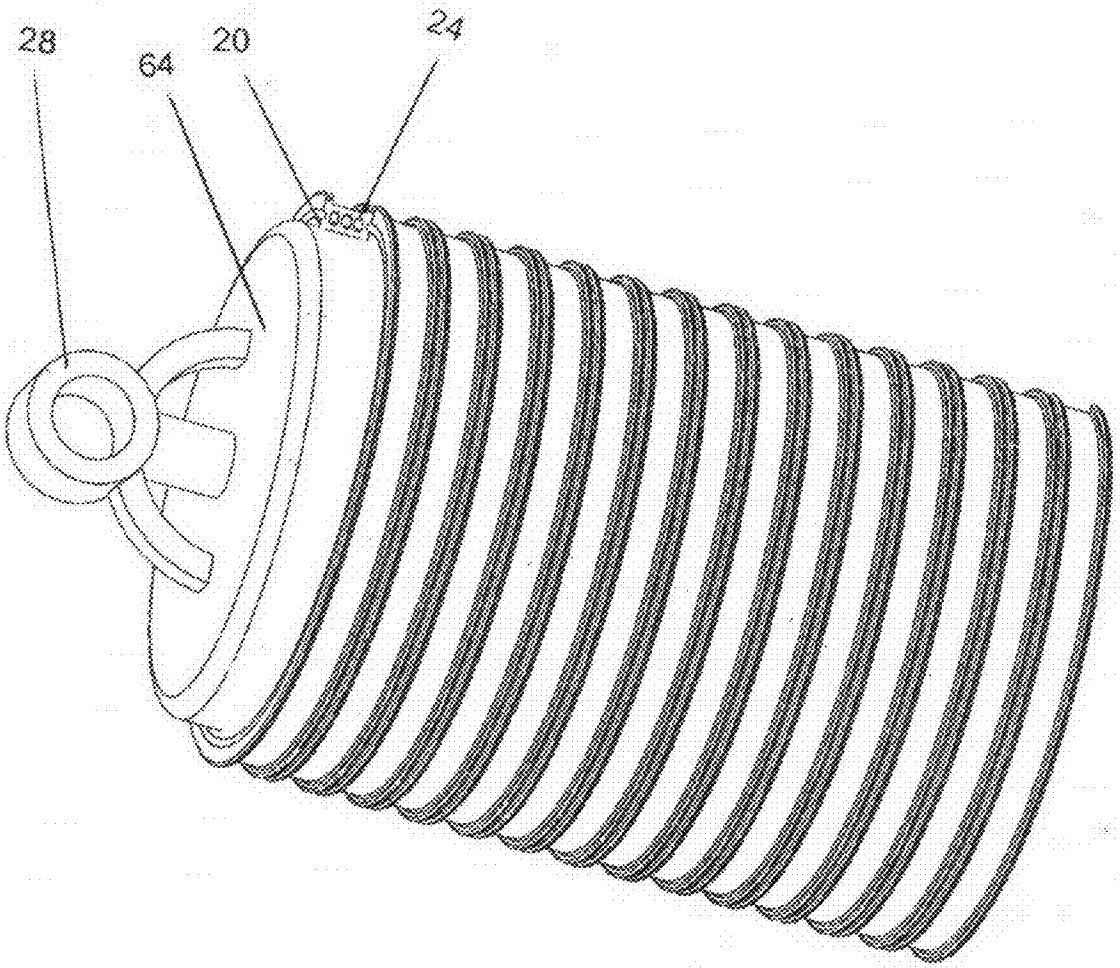
FIG. 2 is a three dimensional view of the transparent container apparatus for live fish and sea animals

Referring to FIGS. 1 and 2, a preferred embodiment of transportable and built on-site container apparatus with controlled floatation and with self-collecting means for water flooding emergency is shown in three-dimensional view with one end cover removed.

Helical spring 20 made of high strength wire with large diameter spring turns of up to 5 meters of uniform pitch provides the main mechanical structure of the container. End cover 64 is mechanically threaded and structurally attached to the helical spring 20 wire turns at each end of the container apparatus.

A continuous sealing wall strip 24 is wrapped around the helical spring and made of resilient and elastic plastic material with recycled plastic material. In FIG. 2 the sealing wall strip is made of transparent plastic material that allow sun rays to penetrate through the container apparatus wall making the container used as aquarium for large fish and sea animals.

Figure 3:
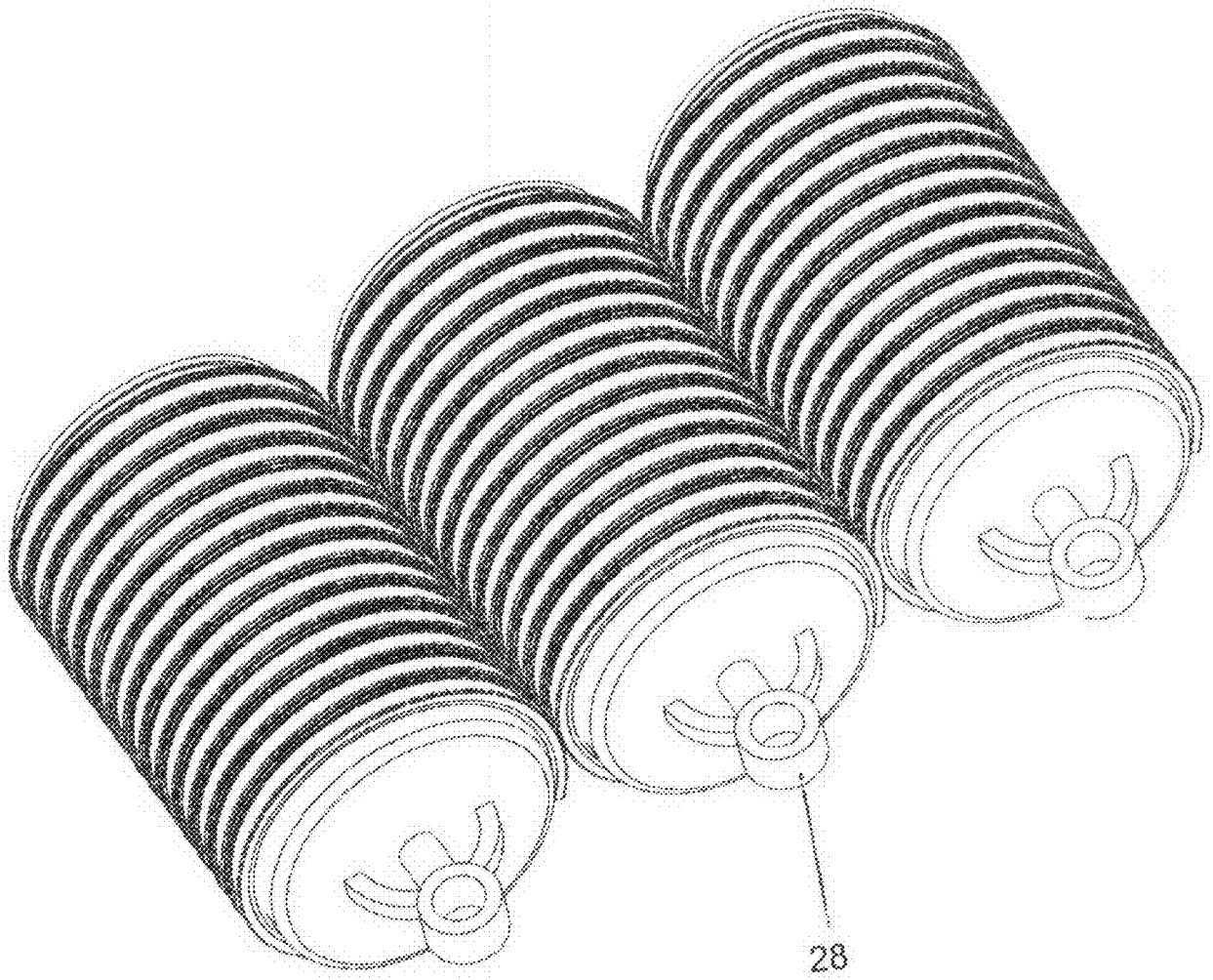
FIG. 3 is a three dimensional view of three container apparatus configuration

The container apparatus configuration of FIG. 3 consists of three parallel container apparatus configuration that are laterally connected along their side to each other with high strength cable means is shown in three-dimensional view.

Towing ring means 28 for towing the container apparatus is attached to the end cover 64.

Figure 4:
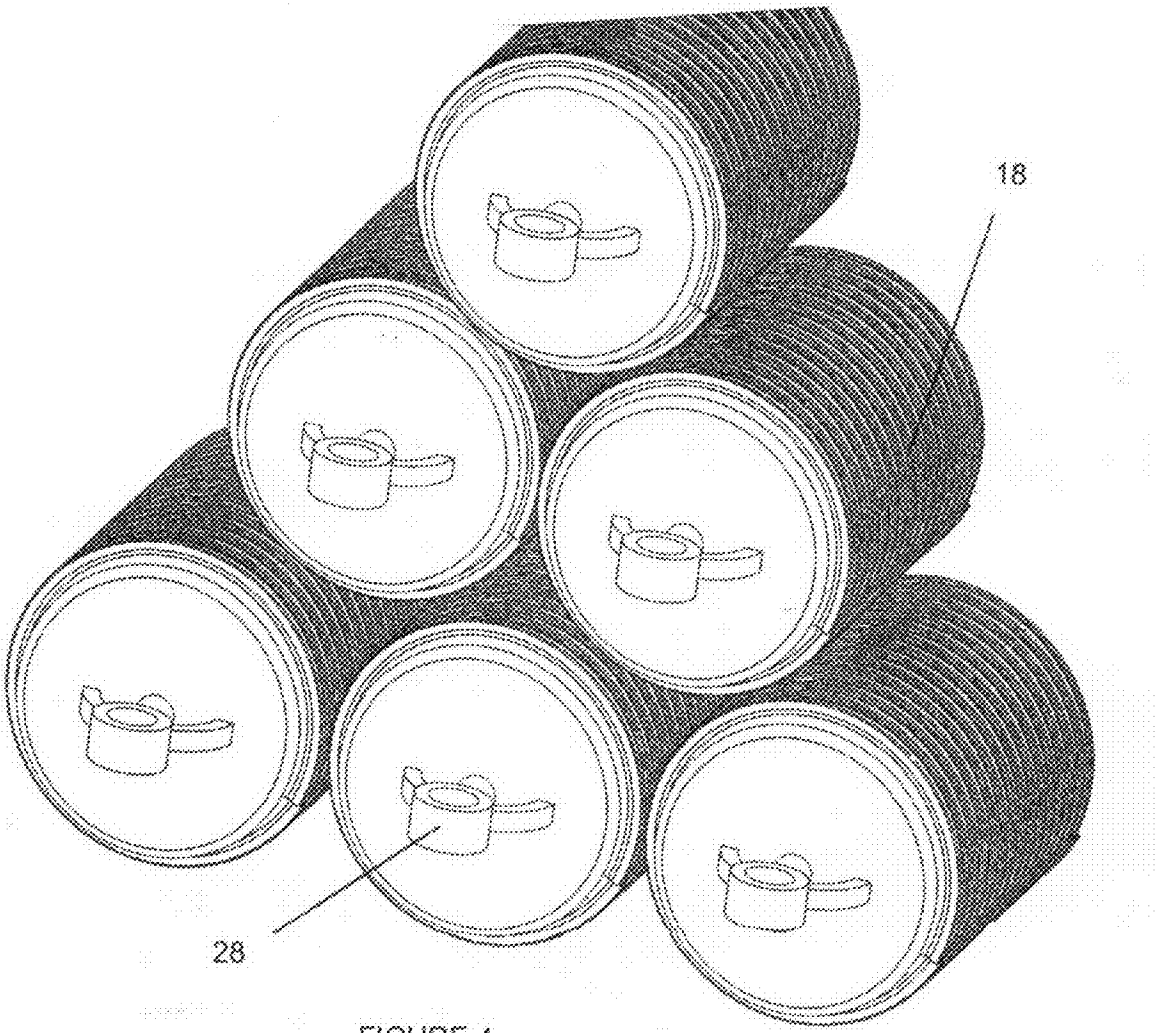
FIG. 4 is a three dimensional view of six container apparatus configuration

Referring to FIG. 4, a preferred embodiment of six-container apparatus 18 configuration is shown in three-dimensional view. In multiple container apparatus configuration, each container apparatus is structurally attached to other similar container apparatus with high strength wire cable through attachment rings connected to cross bar members in both container apparatuses to form multi-container apparatus configuration. The total amount of collected fluid that can be towed with three towing rings 28 as one unit over flooded river, sea or ocean is multiplied.

The container apparatus provides an emergency transportable and built on-site container apparatus with controlled floatation and with self-collecting means for large volume of water such as floodwater in rivers and water reservoirs.

The container apparatus is capable of self-collecting water without pump from river and water reservoir and transporting drinking, irrigation water, flood water, oil spill or other fluids from its building site location to desert and dry areas by towing means.

The container apparatus with controlled floatation and with self-collecting means for large volume of water is comprised of the largest diameter and longest helical steel wire spring that is practically transportable in compressed mode by land, air or naval transportation to the water flooded site.

Figure 5:
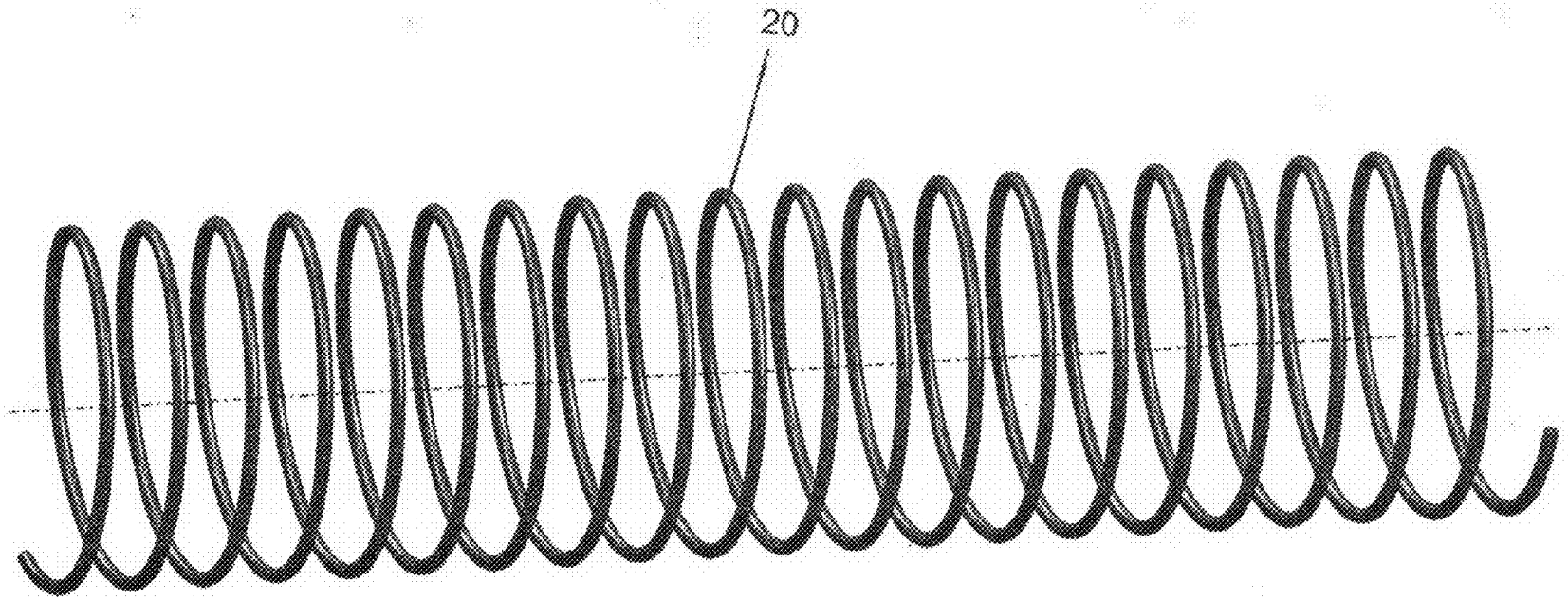
FIG. 5 is a three dimensional view of helical spring
Figure 6:
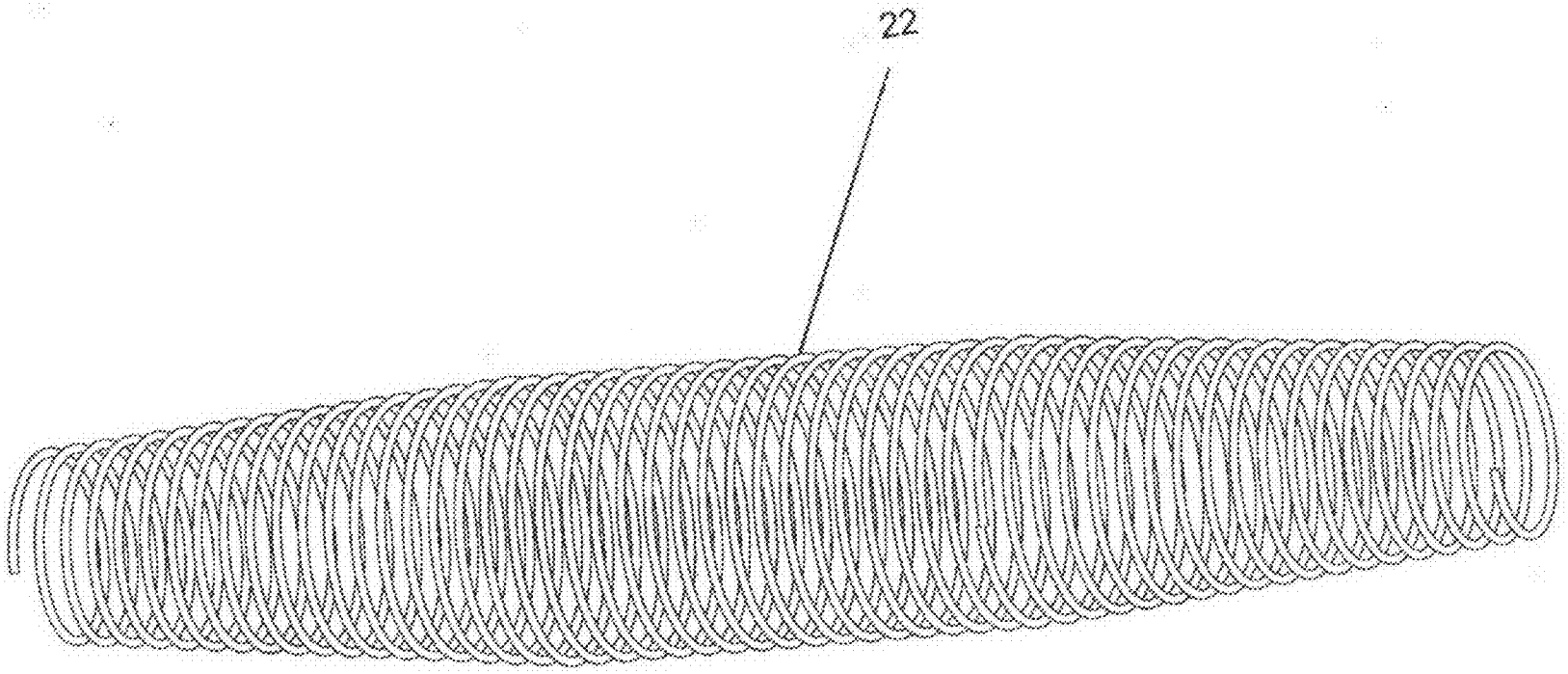
FIG. 6 is a three dimensional view of special helical spring with two tapered ends

Referring to FIG. 5, a preferred embodiment of the helical spring 20 consists of multiple high strength wire turns that provide the structural support to the container wall is shown in three-dimensional view Referring to FIG. 6, a preferred embodiment of special helical spring with two tapered helical springs 22 at the two ends is presented. The reduced diameter at the ends allow reduction of the volume of the helical spring during transportation as the spring wire turns with smaller size diameter are compressed into the larger wire turns diameter for easy transportation to assembly site. Helical spring 20 and helical spring with tapered ends 22 are allowed to extend to their free length at the assembly site location and the container apparatus is assembled with helical spring at free length condition.

Figure 7:
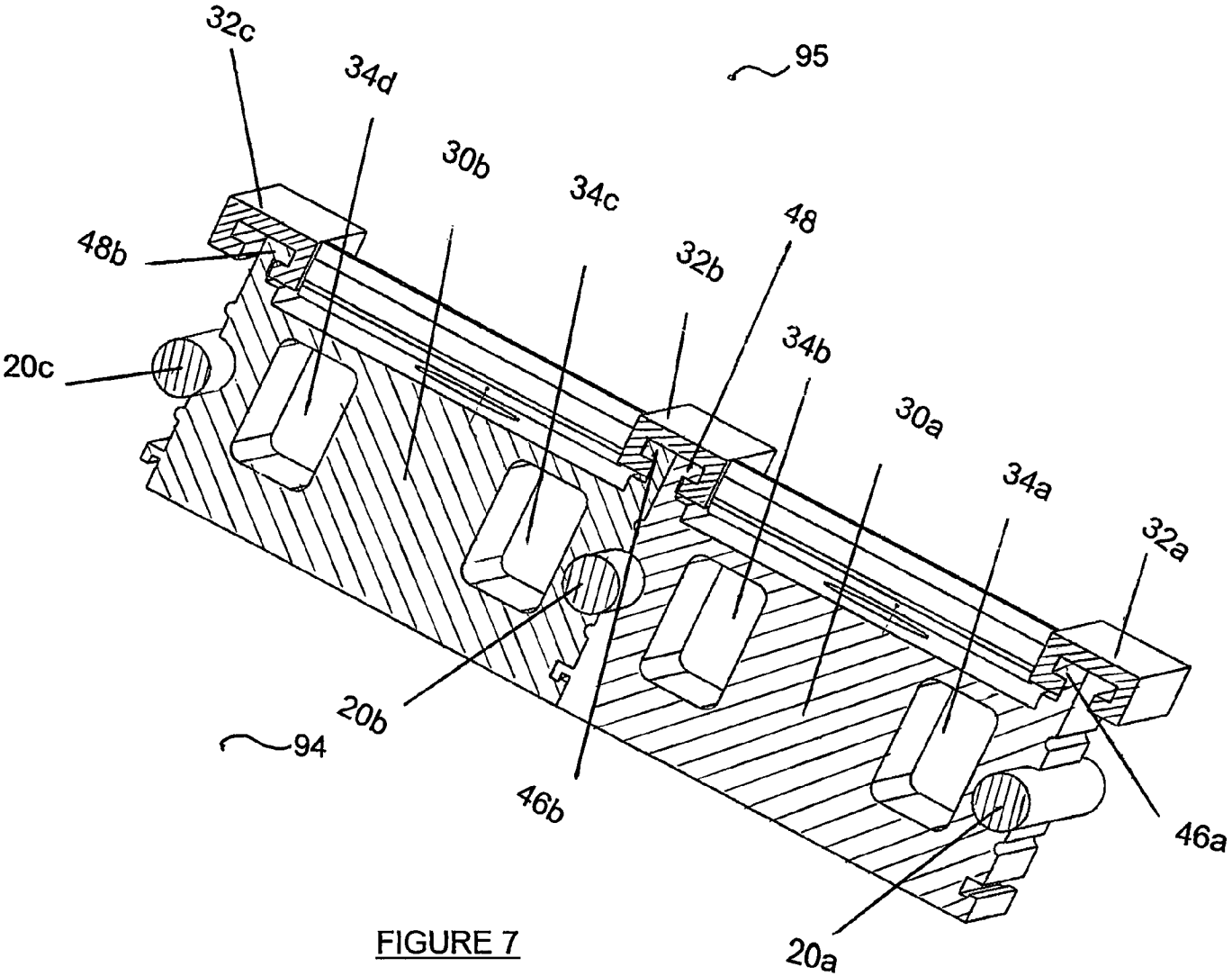
FIG. 7 is a cross sectional view of the helical spring and helical strip wall

Referring to FIG. 7, a preferred embodiment of helical strip wall is shown in cutaway view. The helical strip wall is molded from elastic and strong plastic material such as Polyethylene while other similar recycled plastic materials are available for the application. The cutaway shows the internal side 94 and the external side 95 of the helical strip wall of the container where there is either water or air.

The helical strip wall 30*a*, 30*b* with multiple helical inflation cavities 34*a*, 34*b*, 34*c*, 34*d* is creating internal and external wall of the container apparatus that is wrapped around and attached to the helical spring turns 20*a*, 20*b*, 20*c* on left side and on right side of the helical strip wall.

When inflated with compressed air from both ends, the volume of the helical inflation cavities 34*a*, 34*b*, 34*c*, 34*d* expands and increases the volume of the helical strip wall of the container apparatus and thereby amplifies its buoyant upward force that is controlled by the level of the compressed air pressure. Helical Clamp 32*a*, 32*b*, 32*c* with internal T-shape cross section structurally secures together extended helical L-shape 48*a*, 48*b* on right end and 46*a*, 46*b* and on left end of helical strip wall 30*a*, 30*b* over helical spring wire turns 20*a*, 20*b*, 20*c*.

When collecting water into the container apparatus, the air pressure is low to keep the container apparatus at low level. When the container apparatus is filled with water, the air pressure increased and the container floats at higher level as needed.

The helix shaped band is wrapped between every spring wire turn and the adjacent wire turn of the helical spring while right lateral side of the band is connected to its left lateral side around the helical spring wire turn.

Figure 8:
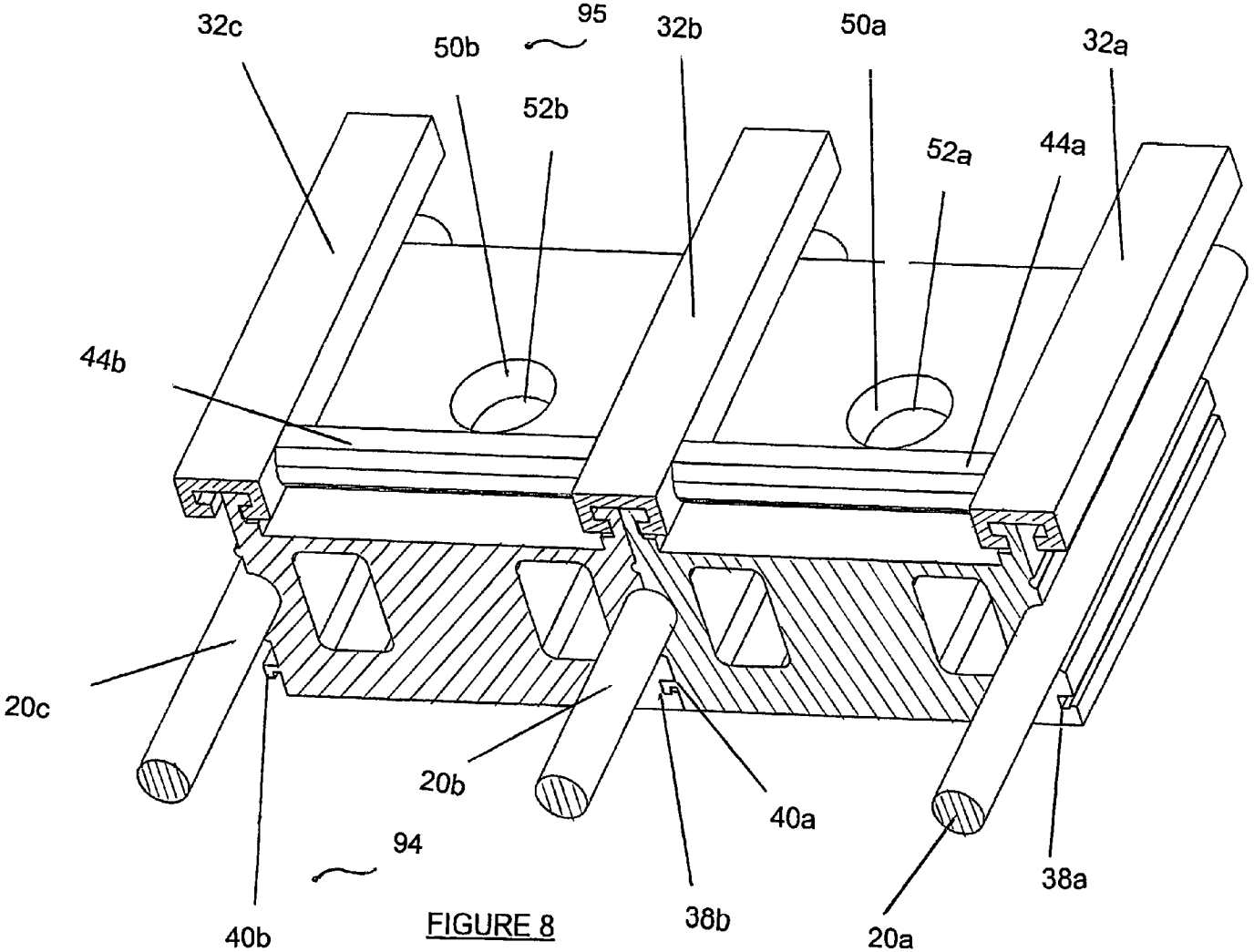
FIG. 8 is a cross sectional view of the helical spring, helical strip wall and helical clamp

Referring to FIG. 8, a preferred embodiment of helical strip wall and helical spring wire turns is shown in cutaway view. The cutaway shows the internal side 94 and the external side 95 of the helical strip wall of the container where there is either water or air.

Cross sectional view of the helical strip wall 30*a*, 30*b* shows flow collection holes 50*a*, 50*b* and ball shaped floating member 52*a*, 52*b* that can move to the internal side of the hole to allow full flow into the container apparatus or to the external side of the hole to prevent flow from the container. The flow collection holes 50*a*, 50*b* are spaced along the helical strip wall from one end to the other. The flow collection holes are located all around the container wall perimeter with some submerge in the external water and some open to the atmospheric air pressure. The floating ball member is hollow and comprises of thin wall similar to light weight table tennis ball with large volume relative to its weight so that when submerges in water the buoyant force exceeds its gravitational force by ratio of more than twenty to one ratio.

In addition, helical L-shaped extension 40*a*, 40*b* on the left side of said helical strip wall internal side mates within L-shape cavities 38*a*, 38*b* in the right side to structurally secure the internal side of the helical strip wall.

Figure 9:
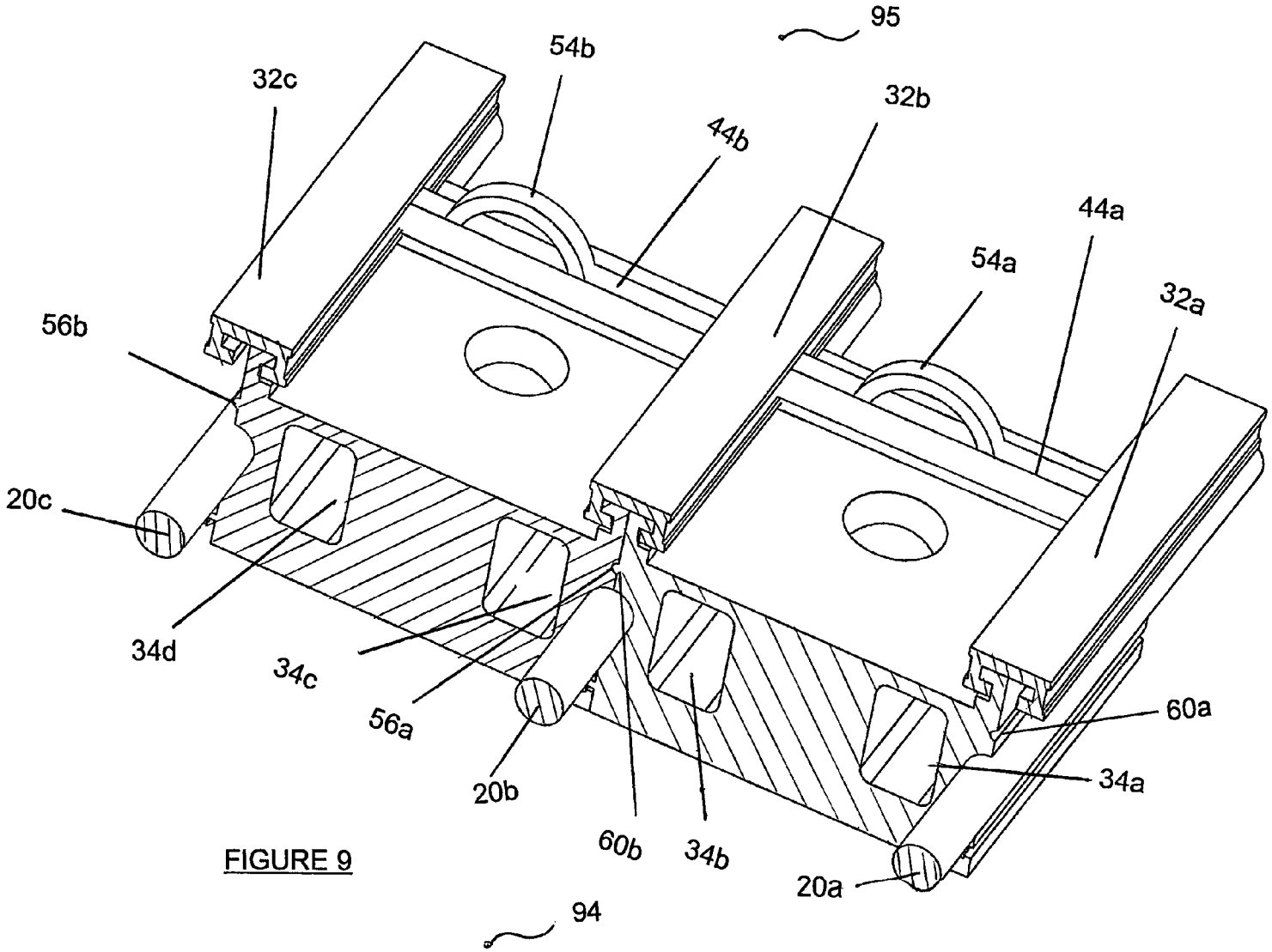
FIG. 9 is a cross sectional view of the helical spring, helical strip wall, helical clamp and cross bar members

Referring to FIG. 9, a preferred embodiment of helical strip wall with helical clamp wrapped around helical spring wire turns is shown in cutaway. The cutaway shows the internal side 94 and the external side 95 of the helical strip wall of the container where there is either water or air.

A cross bar connection means 44*a* with attachment ring 54*a* for external cable connection mechanically connects helical clamp 32*a* over helical spring wire turn 20*a* with clamp 32*b* over the adjacent spring wire turn 20*b* similarly cross bar connection means 44*b* with connection ring 54*b* connects helical clamp portion 32*b* to helical clamp portion 32*c* over the adjacent helical spring wire turn 20*c*. Cross bar connection means creates longitudinally strong construction of the container, capable of connecting to other container with cable through attachment rings and supporting it during towing of the container apparatus.

Helical sealing protrusion means 56*a*, 56*b* within the left side fits into similar shaped helical sealing cavity 60*a*, 60*b* in the right side of the helical strip wall to create water tight seal between right and left side ends of the helical strip wall.

Figure 10:
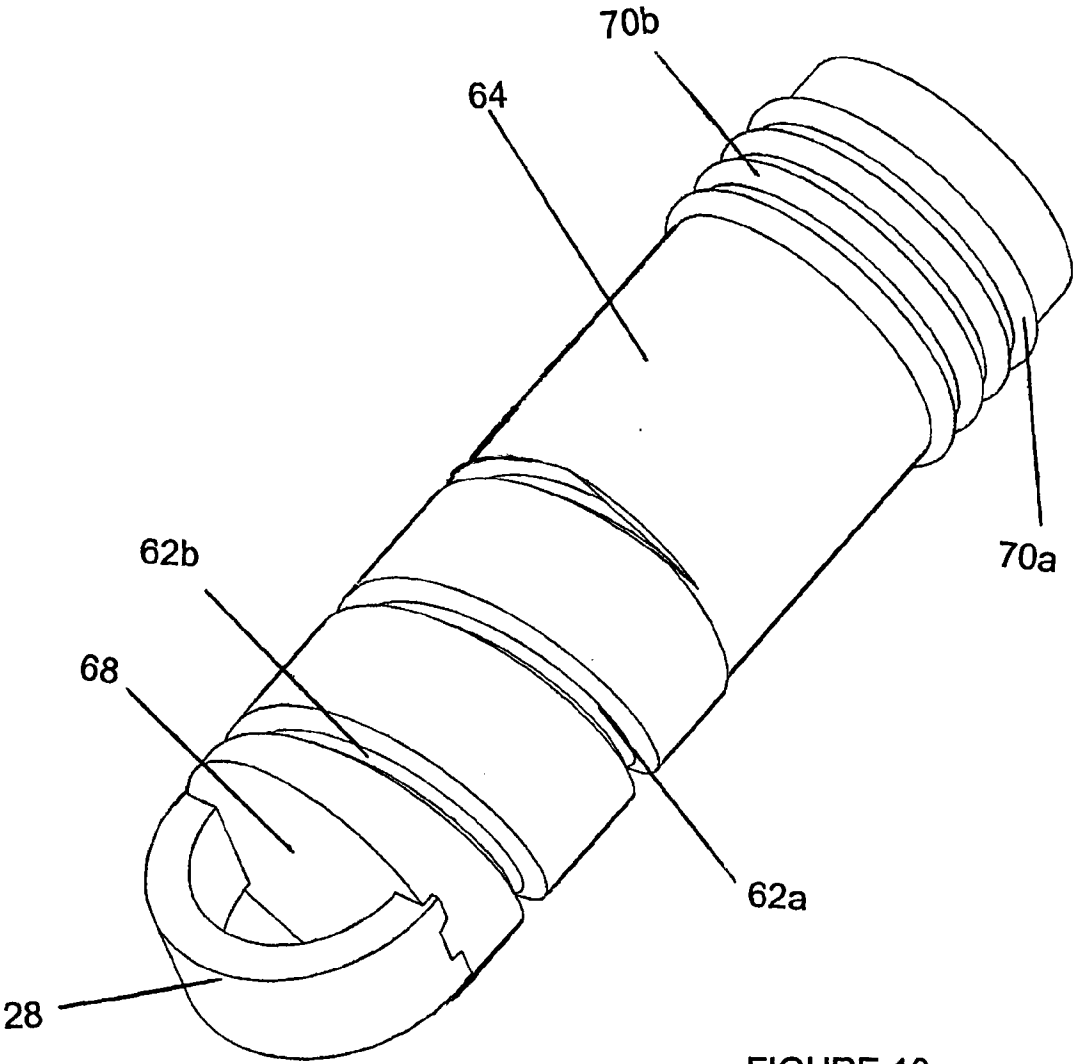
FIG. 10 is a three dimensional view of the end cover

Referring to FIG. 10, a preferred embodiment of end cover configuration is shown in three-dimensional view. The end-covers 64 on both sides of the container apparatus are equipped with structural towing ring means 28. The end covers are threaded into the container apparatus from both side and structurally held with the helical spring wire turns 20 that engage helical thread grooves 62*a*, 62*b* in the cylindrical cap. The end cover 64 consists of cylindrical cap shape with vertical sealed wall 68 and with multiple external radial sealing protrusions 70*a*, 70*b* on its perimeter that engages with the internal wall of the helical strip wall.

The multiple water self-collecting apparatus allows water to flow into the container apparatus while preventing water flow or leak away from the container apparatus.

Figure 11:
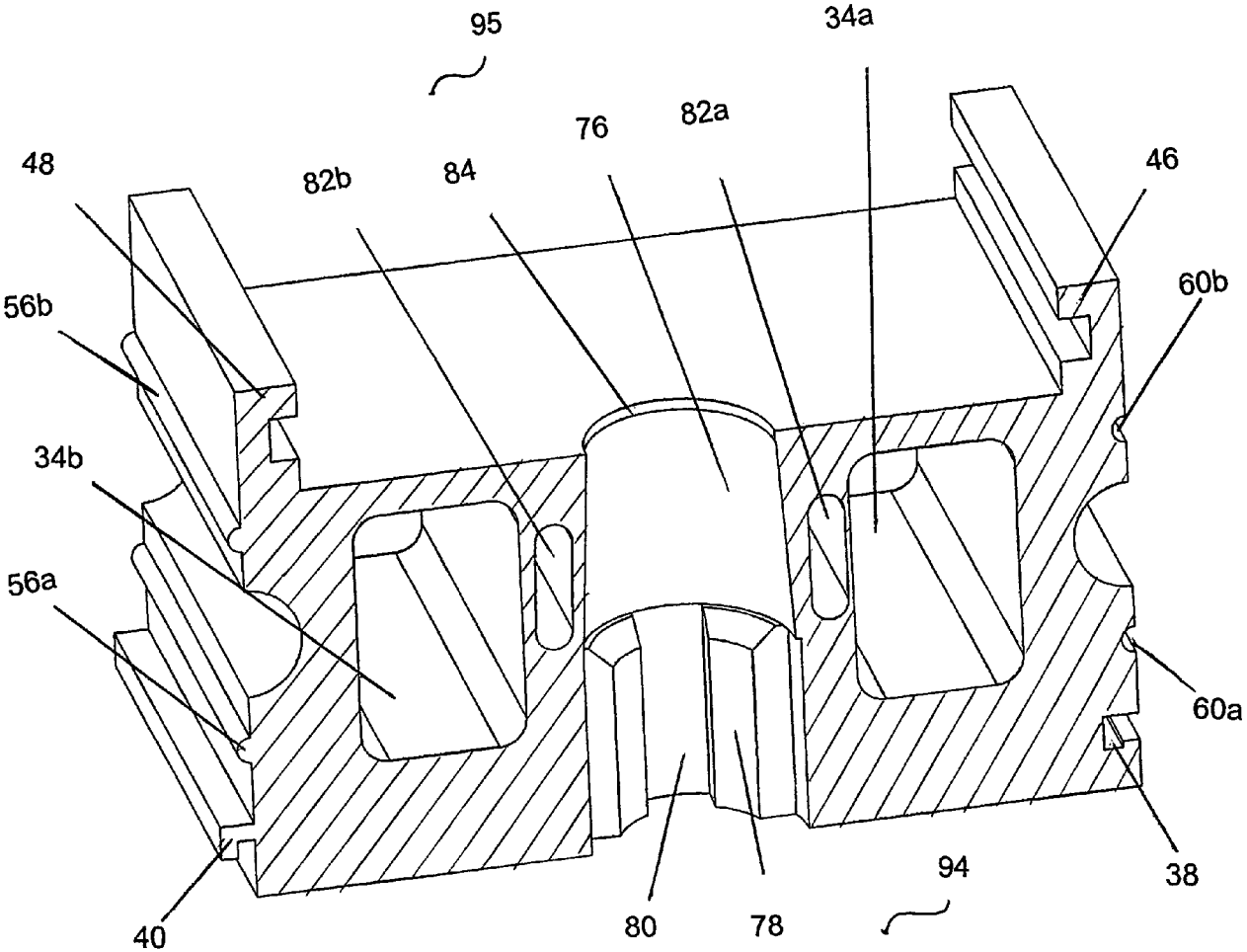
FIG. 11 is a cross sectional view through the helical strip wall and flow collection holes

Referring to FIG. 11, a preferred embodiment of the helical strip wall 30*a*, 30*b* with flow collection holes 50, floating ball 52 and with float retaining cavities 82*a* and 82*b* are shown in cutaway view. The cutaway shows the internal side 94 and the external side 95 of the helical strip wall of the container where there is either water or air.

A light floating ball moves under external water 95 pressure to the internal side and pushed against mechanical stop protrusion 78 with diameter smaller than floating ball. Radial flow cavities 80 located between mechanical stop protrusions 78 allow maximum water flow around the floating ball into the container apparatus. The tapered portion 76 of the flow collection hole has smaller diameter than the floating ball diameter on the external side of the hole which stops the ball and creates seal with sealing lip 84. The gravitational force of the floating ball is negligible and its effect on the water pressure force on the floating ball is of lower significance. Helical float retaining cavities 82*a* and 82*b* along the helical strip wall have elongated narrow shape and are located adjacent to tapered hole 76 portion of the flow collection hole. When inflated by compressed air pressure from both sides of said helical strip wall, the helical float retaining cavities 82*a*, 82*b* expands into the tapered hole and pushing the floating ball toward the external sealing edge 84. When water level in the container reached desired level, compressed air from both sides of the helical strip wall is used to inflate the helical inflation cavities 34*a*, 34*b* which increases helical strip wall volume thus increasing buoyant force and raising the container to higher level relative to external water level. At elevated level, water pressure in the container is higher than external water pressure across every flow collection hole and the internal water pressure push the floating ball towards the external side of the tapered hole 76 and stopping at sealing lip 84. When container is filled to desired level and during towing of the container, compressed air pressure is continuously applied to helical floating ball retention cavities 82*a*, 82*b* to keep the float balls at sealed condition against sealing lip 84 to prevent ball movement which could cause water leakage.

Figure 12:
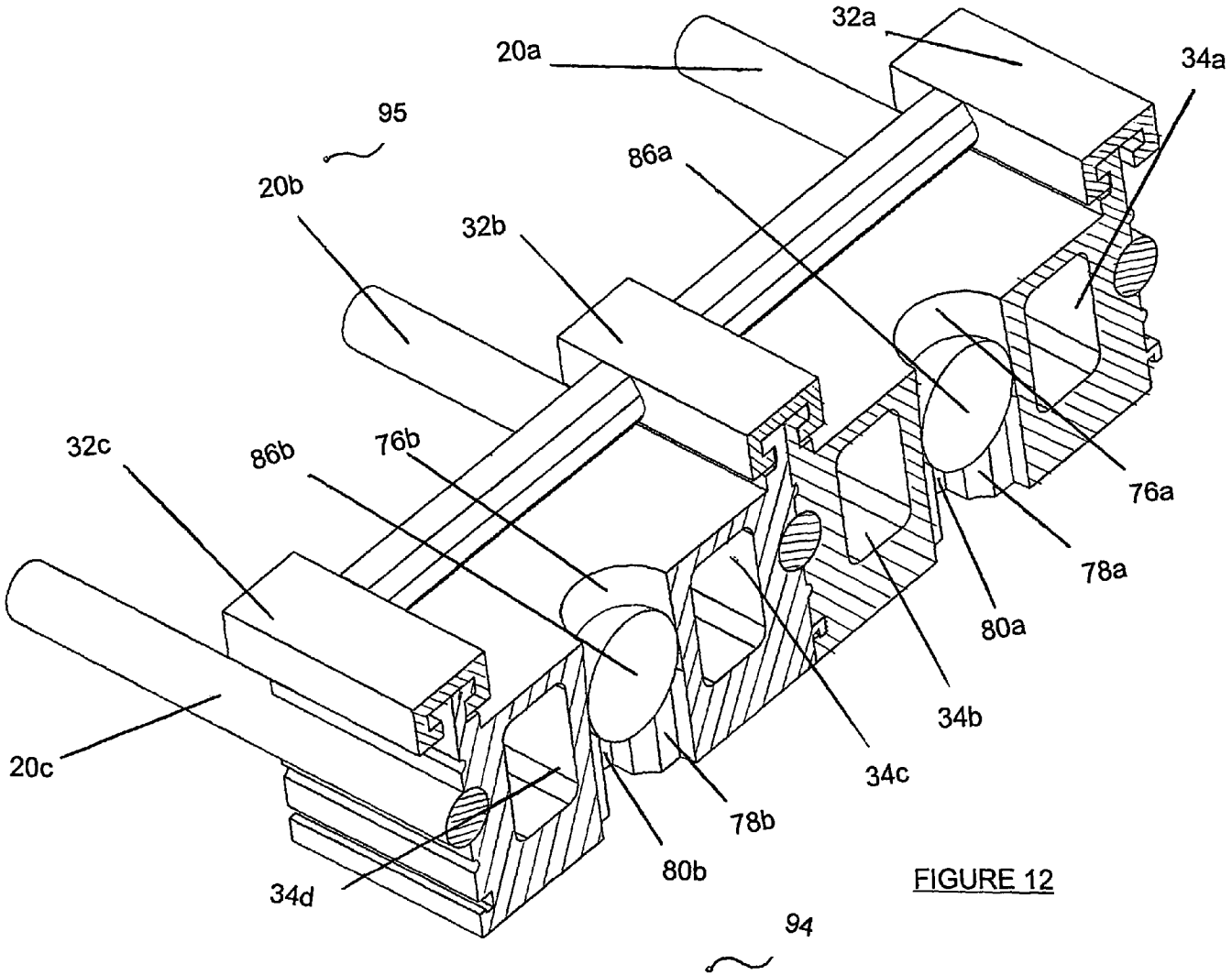
FIG. 12 is a cross sectional view through the helical strip wall with floating ball retention cavities

Referring to FIG. 12, a preferred embodiment of continuous helix shaped strip with float retention cavities of the self-collection apparatus is shown in side view. The tapered hole 76 allows the ball type float 86 to move up under water pressure and gravitational pressure and create seal against the sealing edge 84. When the container 18 is filled with water to the required level, the float retention cavities are pressurized with compressed air and their volume increase as they push the float up against the sealing edge aiming at locking and retain the float at sealed position that prevents water leakage from the container during towing. When the water level inside the container builds up, the floating means is pushed by the water pressure to move up the tapered hole into reduced diameter to create seal with the hole thus preventing leakage of water out of the container. Helical compression spring between the floating means and the sealing edge at the external side keeps the floating ball at the inner side to allow maximum flow rate into the container. The spring forced is designed to control the water pressure that will overcome the spring force and push the floating means move up an engage the sealing edge to close the water leakage from the container. Initially the container sinks into the water under its own weight with minimum inflating pressure in the sealing wall cavities.

When launched into the river, with no inflating pressure in the helical inflation cavities 34*a*, 34*b*, 34*c*, 34*d* the container sinks into the water under its own weight. The external water pressure at the lowest depth of the container is high while the pressure inside the empty container is low or zero, therefore the external water pressure pushes the floating balls 86*a*, 86*b* toward the mechanical stop 78*a*, 78*b* against the negligible gravitational force of the floating ball and the water flow through the radical flow cavities 80*a*, 80*b* into the container similar to water flowing into broken walled ship.

After some time, the water in the container will reach the height equal to the submerged depth of the container in the external water and the water pressure across each flow collection holes will equalized so that water flow will stop. At this new condition, compressed air is applied from both ends of the helical strip wall to the helical inflation cavities to inflate the helical strip wall and increase the volume of the container for increased buoyancy force based on Archimedes Principle.

When inflated, the container will move up until the volume of the displaced river water equals to its weight based on Archimedes' principle, physical law of buoyancy. Archimedes principle stating that any body completely or partially submerged in a fluid at rest is acted upon by an upward, or buoyant, force the magnitude of which is equal to the weight of the fluid displaced by the body. After being raised to higher level of the container relative to external water, the internal container water pressure exceeds the external water pressure across each water collecting hole.

At higher level of the container relative to external water, the internal water pressure in the container exceeds the external water pressure across every flow collection hole. The internal water pressure push the floating ball 86*a*, 86*b* toward the external end and sealing lip and prevent water leakage from the container. At this condition, pressured air supply from both sides to helical ball retaining cavities to expand the cavities and apply retention force on the floating balls at 86*a*, 86*b* sealed condition.

The water can be pumped from one container apparatus to another for maximum and optimized water capacity that can be towed together along the river by towing boat or ship.

What is claimed is:

1. A fluid container apparatus with controlled floatation means comprises:

A. a helical spring member means made of continuous wire formed into multi uniform pitch turns whereby said helical spring wire turns provide constructional support of the container apparatus helical wall strip and constructional support to its end covers that are mechanically secured to said helical spring by being threaded into said spring wire turns and B. helical strip wall with flexible cross section that is wrapped between each helical spring wire turn and the adjacent wire turn of said helical spring with its right strip lateral side attached to the left strip lateral side along each said helical wire turn whereby said wire turn is encapsulate between lateral right and left side of said helical strip wall and said helical strip wall creates continuous sealed wall and B1. said helical strip wall cross section contains multiple continuous helical inflatable cavities throughout said helical strip wall whereby said inflatable cavities increase their volume when compressed air pressure is applied to from both sides of said helical strip wall thereby increase buoyancy force on said container apparatus and B2. said helical strip wall cross sectional internal side contains helical protrusion on right side and helical cavity that conforms to the shape on left side whereby protrusion of right side fits into cavity on left side along each said wire turn to create structural wall on the internal side of said helical strip wall and B3. said helical strip wall cross section contains helical lateral protrusion on right side and helical lateral protrusion on left side on external side of the cross section whereby L-shape protrusion of right side and mirror view L-shape on left side create T-shape protrusion on external of said helical strip wall cross section along each said wire turn to create structural wall with clamping means and B4. Said helical strip wall cross section contains multiple helical sealing member protrusions of the right side and conforming helical cavities on the left side whereby said helical sealing protrusion fits into said helical sealing cavity to create sealed helical wall and prevent water leakage through said container apparatus wall and C. helical clamping means with lateral elongated cavity structurally attach together said right and left side cross sectional lateral protrusion of said helical strip wall around each helical spring turn whereby said helical clamping means fix together external right and left sides of said helical strip wall to form sealed structural wall of said container apparatus and D. multiple cross bar connecting members mechanically connect between said helical clamping means across said wire turn whereby said connecting cross bar members provide structural longitudinal and lateral stiffness and attachment means between multiple container apparatuses and D1. said cross bar connecting member means contains attachment ring wherein strong cable means used to connect said attachment ring to said cross bar member means of parallel installed another container apparatus through said attachment ring of said another container apparatus and E. end cover members located at each end of said helical spring comprising E1. said end cover member contains multiple continuous helical with helix shaped thread groves wherein said thread grooves are treaded into said helical spring wire turns thereby said threaded engagement structurally secure said end cover to said helical spring and E2. said end cover member contains multiple radial resilient sealing protrusion means wherein said radial sealing protrusion means engaging said helical strip wall internally thereby said radial sealing protrusions means provide sealing against said helical strip wall end.

2. A fluid container apparatus with controlled floatation and with self-collecting means for fluids comprises F. a helical spring member means made of continuous wire formed into multi uniform pitch turns whereby said helical spring wire turns provide constructional support of the container apparatus helical wall strip and constructional support to its end covers that are mechanically secured to said helical spring by being threaded into said spring wire turns and G. helical strip wall with flexible cross section that is wrapped between each helical spring wire turn and the adjacent wire turn of said helical spring with its right strip lateral side attached to the left strip lateral side along each said helical wire turn whereby said wire turn is encapsulate between lateral right and left side of said helical strip wall and said helical strip wall creates continuous sealed wall and G1. said helical strip wall cross section contains multiple continuous helical inflatable cavities throughout said helical strip wall whereby said inflatable cavities increase their volume when compressed air pressure is applied to from both sides of said helical strip wall thereby increase buoyancy force on said container apparatus and G2. said helical strip wall cross sectional internal side contains helical protrusion on right side and helical cavity that conforms to the shape on left side whereby protrusion of right side fits into cavity on left side along each said wire turn to create structural wall on the internal side of said helical strip wall and G3. said helical strip wall cross section contains helical lateral protrusion on right side and helical lateral protrusion on left side on external side of the cross section whereby L-shape protrusion of right side and mirror view L-shape on left side create T-shape protrusion on external of said helical strip wall cross section along each said wire turn to create structural wall with clamping means and G4. Said helical strip wall cross section contains multiple helical sealing member protrusions of the right side and conforming helical cavities on the left side whereby said helical sealing protrusion fits into said helical sealing cavity to create sealed helical wall and prevent water leakage through said container apparatus wall and H. helical clamping means with lateral elongated cavity structurally attach together said right and left side cross sectional lateral protrusion of said helical strip wall around each helical spring turn whereby said helical clamping means fix together external right and left sides of said helical strip wall to form sealed structural wall of said container apparatus and I. multiple cross bar connecting members connect between said helical clamping means across each said wire turn whereby said connecting cross bar members provide structural longitudinal and lateral stiffness and attachment means between multiple container apparatuses and J. end cover members located at each end of said helical spring comprising J1. said end cover member contains multiple continuous helical with helix shaped thread groves wherein said thread grooves are treaded into said helical spring wire turns thereby said threaded engagement structurally secure said end cover to said helical spring and J2. said end cover member contains multiple radial resilient sealing protrusion means wherein said radial sealing protrusion means engaging said helical strip wall internally thereby said radial sealing protrusions means provide sealing against said helical strip wall end and K. multiple flow control members each comprising of through hole from external side to internal side of said wall strip and a floating member movable within said hole whereby said flow collection holes allow fluid flowing into said container apparatus to fill said container apparatus and K1. Said flow control hole comprising mechanical stop means on the internal side of said helical strip wall with flow cavities around said floating members that connect to the said container apparatus internal cavity whereby floating member pushed by external fluid pressure away from the external side to engage said mechanical stop member thus allowing the flow through said flow cavities into said container apparatus and K2. Said flow control hole comprising sealing member on the external side of said helical strip wall at smaller diameter than said of said floating member whereby said floating member prevents flow out of the container through said flow control hole when it is pushed against said sealing member.

3. A fluid container apparatus with controlled floatation means and flow self collection and wall sealing holding means comprises:

L. a helical spring member means made of continuous wire formed into multi uniform pitch turns whereby said helical spring wire turns provide constructional support of the container apparatus helical wall strip and constructional support to its end covers that are mechanically secured to said helical spring by being threaded into said spring wire turns and M. helical strip wall with flexible cross section that is wrapped between each helical spring wire turn and the adjacent wire turn of said helical spring with its right strip lateral side attached to the left strip lateral side along each said helical wire turn whereby said wire turn is encapsulate between lateral right and left side of said helical strip wall and said helical strip wall creates continuous sealed wall and M1. said helical strip wall cross section contains multiple continuous helical inflatable cavities throughout said helical strip wall whereby said inflatable cavities increase their volume when compressed air pressure is applied to from both sides of said helical strip wall thereby increase buoyancy force on said container apparatus and M2. said helical strip wall cross sectional internal side contains helical protrusion on right side and helical cavity that conforms to the shape on left side whereby protrusion of right side fits into cavity on left side along each said wire turn to create structural wall on the internal side of said helical strip wall and M3. said helical strip wall cross section contains helical lateral protrusion on right side and helical lateral protrusion on left side on external side of the cross section whereby L-shape protrusion of right side and mirror view L-shape on left side create T-shape protrusion on external of said helical strip wall cross section along each said wire turn to create structural wall with clamping means and M4. Said helical strip wall cross section contains multiple helical sealing member protrusions of the right side and conforming helical cavities on the left side whereby said helical sealing protrusion fits into said helical sealing cavity to create sealed helical wall and prevent water leakage through said container apparatus wall and N. helical clamping means with lateral elongated cavity structurally attach together said right and left side cross sectional lateral protrusion of said helical strip wall around each helical spring turn whereby said helical clamping means fix together external right and left sides of said helical strip wall to form sealed structural wall of said container apparatus and O. multiple cross bar connecting members connect between said helical clamping means across each said wire turn whereby said connecting cross bar members provide structural longitudinal and lateral stiffness and attachment means between multiple container apparatuses and P. end cover members located at each end of said helical spring comprising P1. said end cover member contains multiple continuous helical with helix shaped thread groves wherein said thread grooves are treaded into said helical spring wire turns thereby said threaded engagement structurally secure said end cover to said helical spring and P2. said end cover member contains multiple radial resilient sealing protrusion means wherein said radial sealing protrusion means engaging said helical strip wall internally thereby said radial sealing protrusions means provide sealing against said helical strip wall end and Q. multiple flow control members each comprising of through hole from external side to internal side of said wall strip and a floating member movable within said hole whereby said flow collection holes allow fluid flowing into said container apparatus to fill said container apparatus and Q1. Said flow control hole comprising mechanical stop means on the internal side of said helical strip wall with flow cavities around said floating members that connect to the said container apparatus internal cavity whereby floating member pushed by external fluid pressure away from the external side to engage said mechanical stop member thus allowing the flow through said flow cavities into said container apparatus and Q2. Said flow control hole comprising sealing member on the external side of said helical strip wall at smaller diameter than said of said floating member whereby said floating member prevents flow out of the container through said flow control hole when it is pushed against said sealing member and Q3. Said helical strip wall cross section contains multiple helical float retaining cavities with elongated holes whereby said helical retaining cavities expands when pressurized with compressed air to retain said floating member against said sealing member on the external side of said flow control hole to keep sealing of said flow control hole.

4. The container apparatus means of claim 3 wherein said helical strip wall is transparent whereby light rays penetrate through said helical strip wall for living water animals such as fish and sea animals living or transported in said container apparatus.

5. The container apparatus means of claim 3 wherein said helical spring member consists of cylindrical portion and two tapered sections at both ends.

6. The container apparatus means of claim 3 wherein another container apparatus is attached parallel to said container apparatus using cable means through attachment connecting rings of said cross bar connecting means.

* * * * *